United States Patent [19]

Beatty

[11] 4,060,301

[45] Nov. 29, 1977

[54] ELECTRICAL CONNECTOR FOR TRANSMISSION LINE INSULATORS

[76] Inventor: Albert W. Beatty, 1201 Fairhaven No. 6K, Santa Ana, Calif. 92701

[21] Appl. No.: 450,287

[22] Filed: Mar. 12, 1974

[51] Int. Cl.[2] ..... H01R 7/04

[52] U.S. Cl. ..... 339/95 R; 151/35

[58] Field of Search ..... 339/95, 97–99; 151/35

[56] References Cited

U.S. PATENT DOCUMENTS

| | | | |
|---|---|---|---|
| 491,173 | 2/1893 | Hayward | 151/35 |
| 936,299 | 10/1909 | Braune | 151/35 |
| 945,127 | 1/1910 | Kollenberg | 151/35 |
| 3,340,494 | 9/1967 | Gutshall | 339/95 A |
| 3,759,471 | 9/1973 | Sholtes | 151/35 |
| 3,761,867 | 9/1973 | Churla | 339/98 |

*Primary Examiner*—Joseph H. McGlynn
*Attorney, Agent, or Firm*—Edgar W. Averill, Jr.

[57] ABSTRACT

An electrically conductive clip is disclosed herein which provides an electrical path between the metal components of transmission line insulators. The clip is a U-shaped, resilient, electrically-conductive member having two arms which form an inner passage way. The clip has at least one sharp contact finger extending in a first direction on one side of the central plane of the member and at least two protrusions extending in a second direction on the other side of this central plane. At least one of the protrusions has a sharp extremity of sufficient hardness to penetrate corrosive and insulative formations which form on the metallic components. The presence of the clip reduces radio and television interference caused by electrical arcing.

13 Claims, 7 Drawing Figures

FIG. 1.
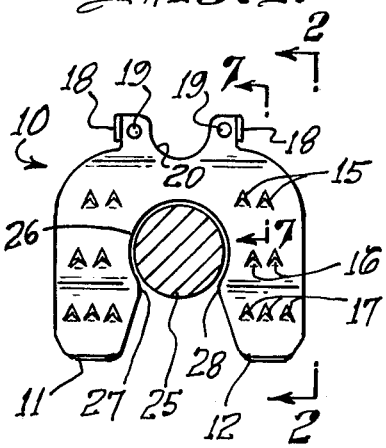
FIG. 2.
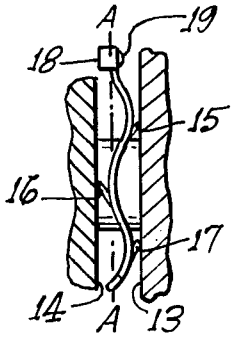
FIG. 6.
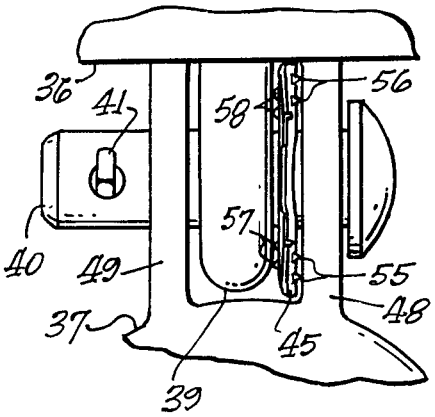
FIG. 4.
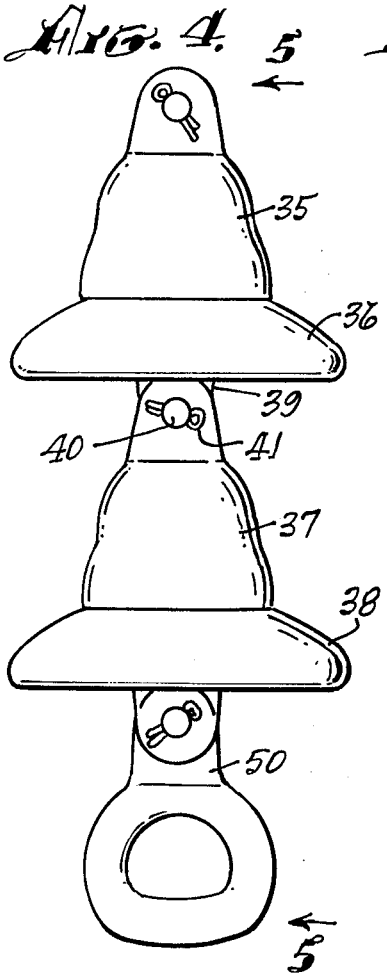
FIG. 5.
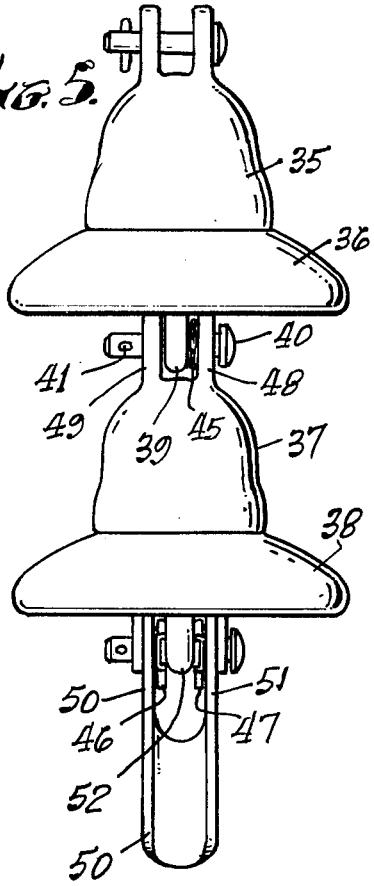
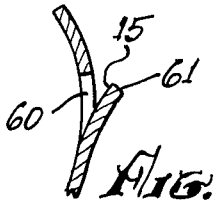
FIG. 7.
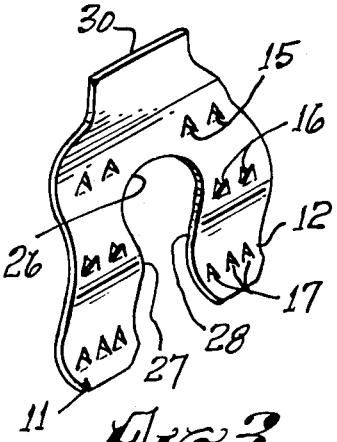
FIG. 3.

ELECTRICAL CONNECTOR FOR TRANSMISSION LINE INSULATORS

BACKGROUND OF THE INVENTION

The field of the invention is transmission line insulators although the conductive clip of this invention is a conductor rather than an insulator. Transmission and distribution line insulators are typically made from a series of ceramic bells which are joined together by a metallic eye cemented into one bell which is pinned to an insulator cap having two clevis ears which is attached to the adjacent bell. These metal members are typically cast or forged maleable iron having a heavy galvanized coating to reduce corrosion.

Upon weathering these metal members tend to corrode and form an insulative coating such as a layer of zinc sulfide. Such coatings tend to inhibit electrical conduction from the clevis ears or pin to the eye of an adjacent insulative member. While the ceramic bells are intended to prevent the flow of electricity, a certain amount of leakage current is associated with the insulators and this leakage current is sufficient to create a sparking or arcing across the sulfide or other corrosive surface of adjacent metallic members.

This corrosive and insulative coating is generally worn away when there is a pull of greater than 100 pounds along the insulators. Where there is less than 100 pounds, particularly when there is less than 50 pounds of tension, there is not sufficient force to wear away the corrosive coatings and the above described arcing or sparking creates television and radio interference. Thus, slack span dead ends or wherever small conductor sizes are terminated gives rise to the undesirable interference.

Historically these radio or television interference problems arising from lightly loaded transmission or distribution line insulators have been attacked by the use of bonding brushes. These brushes were formed from hard metal bristles which were intended to cut into the sulfide coating which had formed on the metal parts. The bonding brushes, however, were not only expensive but also themselves tended to corrode and after a short time radio interference increased to a level greater than that occurring with no brushes at all.

Another approach was to use a simple wire bonding clip such as that disclosed in U.S. Pat. No. 3,270,124. While this device was inexpensive, it was found that the clips did not make sufficient electrical contact and that noise would build up within a year after the installation of the clip. Furthermore, the contact points of the clip often worked their way into an opening between the pin and the eye through which the pin was inserted.

Yet another approach was to connect a conductor between adjacent metal members. This approach was not only expensive but often required live line work together with the necessity of intimate contact with the metal members.

SUMMARY OF THE INVENTION

The present invention is for an electrically conductive clip for providing an electrical path between metal components of transmission line insulators. The clip is a resilient, electrically conductive member comprising a U-shaped sheet deformed from its central plane and having two arms forming an inner passage way which is capable of surrounding the pin or rivet around which it is inserted. The member has at least one sharp contact finger extending in a first direction on one side fo the central plane of the member and at least two protrusions extending in a second direction on the other side of said plane at least one of the protrusions has a sharp extremity having sufficient hardness to penetrate corrosive and insulative formations on the metallic components. After the clip has been inserted between a clevis ear and its associated eye an electrical path exists through at least one of the protrusions of the member through the member itself and through the contact finger on the other side of the member.

BRIEF DESCRIPTION OF THE DRAWINGS

FIG. 1 is a plan view of the clip of the present invention surrounding a pin.

FIG. 2 is a side elevation view of the clip of the present invention taken in the direction 2—2 of FIG. 1.

FIG. 3 is a perspective view of the clip of the present invention.

FIG. 4 is a side elevation of two interconnected insulators of the type useful with the clip of the present invention.

FIG. 5 is a side elevation taken along 5—5 of FIG. 4.

FIG. 6 is an enlarged view of the intersection of the two insulators of FIG. 5.

FIG. 7 is a cross sectional enlarged view taken along line 7—7 of FIG. 1.

DESCRIPTION OF THE PREFERRED EMBODIMENTS

The conductive clip of the present invention is shown in FIG. 1 and indicated generally by reference character 10. The clip is generally U-shaped and has a first arm 11 and a second arm 12. The clip may be formed from a conductive material which should be hard enough to penetrate the sulfide or other corrosive coating likely to occur on the outer surface of the metallic members. The metal should be sufficiently resilient so that a continuous contact is made when the clip is deformed between adjacent surfaces. While beryllium copper may be used, a preferable material of construction is stainless steel with type 301 full-hard stainless steel being ideal. When the metallic members are made from aluminum rather than galvanized iron, a softer material such as beryllium copper may be used.

As shown in FIG. 2, the clip functions as a spring between adjacent surfaces 13 and 14 and provides an electrical path between these two surfaces.

Returning to FIG. 1, the clip has a plurality of tooth-like protrusions such as those indicated by reference character 15. These teeth are formed by cutting a V-shaped notch and pushing the intersection of the V away from the notch. The point of the tooth forms a sharp protrusion which provides an electrical contact with surface 13 as shown in FIG. 2. The teeth indicated by reference character 16 form an electrical contact with surface 14 and the teeth indicated by reference character 17 contact surface 13 and similarly provide an electrical path.

Means for holding and inserting the clip between a clevis ear and adjacent eye may be provided in a variety of ways. The clip shown in FIG. 1 is provided with a pair of ears 18 and a pair of dimples 19 which together with arcuate notch 20 cooperate with an insertion tool not shown.

The clip is held on a pin 25 shown in cross section in FIG. 1. The clip of FIG. 1 is held on to the pin in two separate and independent ways. First, the circular opening 26 has an arc of more than 180° thus forming a pair of prongs 27 and 28 which are spaced closer together than the outside diameter of the pin 25. Secondly, as shown most clearly in FIG. 2 the teeth 15, 16 and 17 are pointed upwardly and away from the arms 11 and 12. Thus, movement of surfaces 13 and 14 tend to work the clip more securely against the pin 25.

Th clip of the present invention is shown in perspective view in FIG. 3 where the clip has a simple flat insertion surface 30 in place of the insertion configuration indicated by reference characters 18 through 20 in FIG. 1. The particular configuration of insertion surface is dependent upon the type of insertion tool used.

One type of insulator which may be equipped with the clip of the present invention is shown in FIG. 4. An insulator cap 35 is formed from galvanized maleable iron. Cap 35 is attached to a ceramic bell 36 which forms an insulative member between cap 35 and cap 37. Cap 37 is identical to cap 35. Similarly, ceramic bell 38 is identical to bell 36. An eye 39 is cemented to bell 36 and is attached to cap 37 by a pin or rivet 40. Rivet 40 is held in place by a conventional hump back cotter pin 41.

Conductive clips of the present invention are indicated by reference characters 45, 46 and 47 in FIG. 5. A conductive path is thus formed between clevis ear 48 through conductive clip 45 through eye 39. Furthermore, the spring action of clip 45 tends to improve the electrical conductivity between eye 39 and clevis ear 49.

As also shown in FIG. 5, two pins 46 and 47 may be inserted when the spacing between the clevis ears 50 and 51 and eye 52 permits.

The conductive clip 45 is shown more clearly in an enlarged view in FIG. 6 where contact teeth 55 and 56 bite through corrosion and contamination deposits down to the metal surface of clevis ear 48. Similarly, teeth 57 and 58 contact eye 39.

While the teeth or protrusions of the present invention may be formed in many ways, a particularly effective way is brought about by cutting a V-shaped notch in the metal sheet and pushing the interior portion of the "V" outwardly away from the metal surface. One side of the notch 60 is shown in FIG. 7 and the tooth 14 has a sharp point 61 which is particularly effective at biting through the resistive and corrosive coating formed on the metal parts.

While the present invention has been described utilizing a tooth formed from a V-shaped notch as a protrusion, other protrusions and contact points may be utilized while not departing from the spirit of the present invention. Thus, the clip could terminate at the end of each arm at the line of the row of teeth indicated by reference character 17 in FIG. 1. This termination could be a simple sharp edge or a serrated or saw-toothed edge. Similarly, the clip could terminate along the line of teeth 15 of FIG. 1 which could be a straight or serrated sharp edge. The insertion tool would, of course, have to modified to cooperate with the clip. Furthermore, the teeth indicated by reference character 16 could be replaced by pointed dimples, conductive rivets or screws, or other sharp edges or fingers.

The clips of the present invention may be installed on live lines with no risks to the installers. The insertion tool should, of course, have an insulative handle and be capable of gripping and inserting the conductive clip.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

I claim:

1. An electrically conductive clip for providing an electrical path between metal components of transmission line insulators, said clip comprising:

a resilient, electrically conductive member comprising a U-shaped sheet deformed from its central plane so that it extends outwardly in both directions from its central plane and having two arms forming an inner passage way, said member having at least one sharp contact finger protruding outwardly away from said plane in a first direction and at least two protrusions extending outwardly away from said plane in the opposite direction, at least one of said protrusions having a sharp extremity with sufficient hardness to penetrate corrosive and insulative formations on the metallic components.

2. The clip of clam 1 wherein each of said protrusions is a "V" shaped angled point.

3. The clip of claim 1 wherein said contact finger is a "V" shaped angled point.

4. The clip of claim 3 wherein said point is directed away from the extremities of said arms, whereby movement of surrounding metal components forces the member in the direction of said arms.

5. The clip of claim 3 wherein said "V" shaped angled point is formed from a "V" shaped cut in said sheet, the inner portion of said cut being extended outwardly from the outer portion of said cut.

6. The clip of claim 1 wherein at least one of said protrusions is a "V" shaped angled point.

7. The clip of claim 3 wherein said protrusion is formed from a "V" shaped cut in said sheet, the base of the "V" shaped cut being extended outwardly from the sheet.

8. The clip of claim 1 wherein said member has at least one finger on each of said arms.

9. The clip of claim 8 wherein said member has two fingers on each of said arms, said fingers being located near the maximum extremity in said first direction.

10. The clip of claim 1 wherein each of said protrusions has a sharp extremity.

11. The clip of claim 10 wherein said member has a plurality of contact fingers.

12. The clip of claim 11 wherein each of said sharp extremities and each of said contact fingers are formed from a "V" shaped cut in said sheet, the inner portion of said cut being extended outwardly from the outer portion of said cut.

13. The clip of claim 12 wherein said member has two contact fingers on each arm, four sharp extremities on one of said protrusions and six sharp extremities on the other of said protrusions.

* * * * *